US005788465A

United States Patent [19]

Luongo et al.

[11] Patent Number: 5,788,465

[45] Date of Patent: Aug. 4, 1998

[54] TOOL-LESS PUMP HEAD CONFIGURATION

[75] Inventors: Joseph A. Luongo, Walpole; Jeffrey Howard Stokes, Franklin; Robert E. Reynolds, Easton; Wade P. Leveille, Douglas; Robert J. Dumas, Upton, all of Mass.

[73] Assignee: Waters Investments Limited, Wilmington, Del.

[21] Appl. No.: 606,149

[22] Filed: Feb. 23, 1996

[51] Int. Cl.[6] ..... F04B 17/00

[52] U.S. Cl. ..... 417/360

[58] Field of Search ..... 417/53, 360, 415

[56] References Cited

U.S. PATENT DOCUMENTS

| | | | |
|---|---|---|---|
| 3,697,197 | 10/1972 | Berglund et al. | 417/360 |
| 4,793,776 | 12/1988 | Thistle et al. | 417/360 |
| 5,127,807 | 7/1992 | Eslinger | 417/360 |

*Primary Examiner*—Timothy Thorpe
*Assistant Examiner*—Peter G. Korytnyk
*Attorney, Agent, or Firm*—Brian L. Michaelis; Anthony J. Janiuk

[57] ABSTRACT

A pump configured so that tools are not required to remove the pump head and disassemble the plunger. A single large hand operated knob or head nut facilitates tool-less pump head removal. The pump head is guided into position in a manifold and held in place by the hand knob. The manifold is designed to receive all the external fluidic connections made to the pump head. Fluid paths to the pump head have been replaced with miniature face seals which facilitate high pressure sealing between the pump head and manifold. Low pressure tubing seals reside in a seal wash chamber or housing and are not attached to the head, eliminating the need for tooling to disconnect them during pump head removal. A tool-less plunger mechanism includes a nutcap assembly having a plunger socket receiving a plunger assembly including a sapphire plunger fixed to a plunger holder ball accommodated by the socket. The plunger assembly is captured within the socket by a plurality of cams. The cams are spring loaded to rotate and collapse onto the plunger holder ball, pulling the plunger assembly tightly into the socket. A restricting cone is actuated to rotate the cams away from the plunger holder ball for release and removal of the plunger assembly.

20 Claims, 5 Drawing Sheets

TOOL-LESS PUMP HEAD CONFIGURATION

1. FIELD OF THE INVENTION

Figure 1:
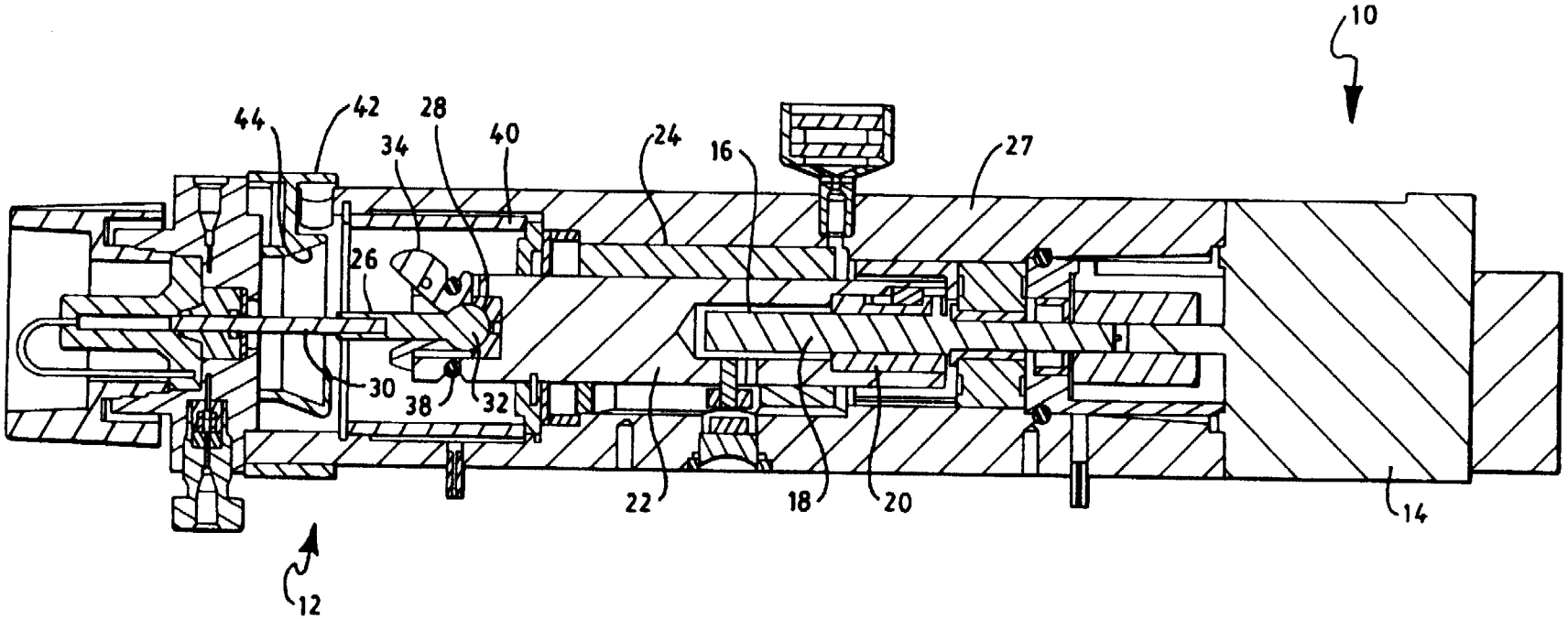

The present invention relates to pumps, and more particularly to pumps used to deliver fluid at high pressure.

2. BACKGROUND OF THE INVENTION

Pumps are known which deliver fluid at high pressure for use in applications such as liquid chromatography. Known pumps, such as one disclosed in U.S. Pat. No. 4,883,409 ("the '409 patent") incorporate at least one plunger or piston which is reciprocated within a pump chamber into which fluid is introduced. The plunger is typically a delicate sapphire piston precisely machined to dimensions accommodated by the pump chamber. Frequency and stroke length of the plunger reciprocating within the pump chamber is controllable to control the flow rate of fluid output from the pump. However, the assembly for driving the plunger is an elaborate combination of elements that can introduce undesirable motion in the plunger as it is driven.

Typical pumps known for delivery of liquids in liquid chromatography applications are dual piston pumps having two interconnected pump heads each with a reciprocating plunger. The plungers are driven with a predetermined phase difference in order to minimize output flow variations, such as disclosed in the '409 patent and further in U.S. Pat. No. 4,681,513.

Routine maintenance of such known pumps, e.g. to replace a plunger or a seal, requires cumbersome manipulation of tools and delicate parts. For instance, removal or attachment of a plunger in the mechanics of these typical known pumps involves the removal of a pump head assembly and manipulation of a compression spring used to eliminate backlash and capture a plunger holder holding the delicate plunger. Manipulation of a snap ring may also be required.

To access the plunger attachment point in a typical pump known in the art, the operator servicing the pump has to unbolt the pump head, which requires one tool, and unbolt a pump head support bushing, which requires yet another tool. Removal of the plunger via manipulation of the compression spring and snap ring requires two additional tools which must be manipulated simultaneously. To remove the plunger, the compression spring has to be compressed to a point at which the snap ring can be collapsed and removed. During any or all of the servicing steps, the operator has to be very careful not to break the exposed fragile sapphire plunger.

Opportunities abound, with pumps known in the art, to inflict damage on delicate pump mechanisms while servicing the device. In reassembling a known pump head following servicing, installation of the pump head onto the already installed plunger has to be conducted in a blind manner possibly causing damage to the plunger seal. That is, the pump head is generally installed with the plunger seal already in place such that the head itself blocks an operators view of the plunger during assembly. There is also a danger, in the cumbersome manipulation of parts during servicing typical known pumps, of dropping and or losing plunger bearings during installation of the pump head onto the plunger because the assembly must be done in a horizontal manner.

Pumps known in the art also require the disconnection (breaking) of fluidic connections while unbolting the pump head to access the plunger seal for replacement in a routine maintenance operation. Typically, two bolts hold the pump head on and resist hydraulic forces generated by the pump. The operation of removing the bolts requires considerable time to complete, and requires a significant level of manual dexterity. Tools and hardware have to be stored and not lost during and between maintenance. Furthermore, uniform torque must be applied when restoring the bolts, otherwise damage can result if the bolts holding the head on are not tightened evenly.

3. SUMMARY OF THE INVENTION

The present invention provides a high pressure pump configured so that tools are not required to remove the pump head and disassemble the plunger.

According to the invention, a single large hand operated knob or head nut holds the pump head on and facilitates tool-less pump head removal. The pump head is guided into position in a manifold and held in place by the hand knob. The manifold is designed to receive all the external fluidic connections made to the pump head. Fluid paths to the pump head have been replaced with miniature face seals which facilitate high pressure sealing between the pump head and manifold when the two components are held against each other. Low pressure tubing seals reside in a seal wash housing which is housed in the manifold and are not attached to the head. No tools are required to disconnect the tubing during pump head removal.

In further accord with the invention, tool-less plunger removal is facilitated by a mechanism including a nutcap assembly having a bronze or brass plunger socket disposed at an end thereof The plunger socket receives a plunger assembly including a sapphire plunger fixed to a plunger holder ball accommodated by the socket. The plunger assembly is captured within the socket by a plurality of cams engaging and permitting only limited pivotal motion of the plunger holder ball within the socket. The cams are constantly loaded by a spring to rotate and collapse onto the plunger holder ball, pulling the plunger assembly tightly into the socket to eliminate backlash between the plunger assembly and the nutcap assembly. The plunger protrudes outwardly from the plunger socket into the pump chamber through a plurality of seals and a restricting cone that facilitates tool-less removal of the plunger assembly and pump head assembly from the pump back-end.

Features of the invention include the single large hand knob which is sized to provide an ergonomic means of applying mechanical holding force required to hold the head in position and compress miniature face seals. The single hand knob eliminates the possible cocking that two bolts used in the prior art may introduce. Fluidic connections in the form of high pressure compression fittings and low pressure tubing connections to the pump head, which are typical in prior art pumps, have been removed from the pump design according to the invention and therefore high pressure fluidic connections do not need to be disconnected in removing the pump head. Furthermore, check valves do not need to be disturbed when removing the pump head. Fittings to the check valves, that had to be removed in prior art pumps, can remain in the valve eliminating the possibility of contamination entering into the check valve.

The design of the pump according to the invention eliminates the need to remove a snap ring which retains a compression spring. This allows the plunger to be removed by simply manually unbolting the head nut knob to free the pump head, manually removing the seal wash tubes, manually positioning the restricting or release cone, and then driving the plunger forward under motor/computer control. Accordingly, the head and plunger assembly are withdrawn without requiring tools. Total elimination of tools required to remove the pump head and plunger is effected, and the risk of breaking the sapphire plunger during removal is substantially reduced. The time involved to change a seal or change a plunger is also substantially reduced.

4. BRIEF DESCRIPTION OF THE DRAWING

Figure 2A:
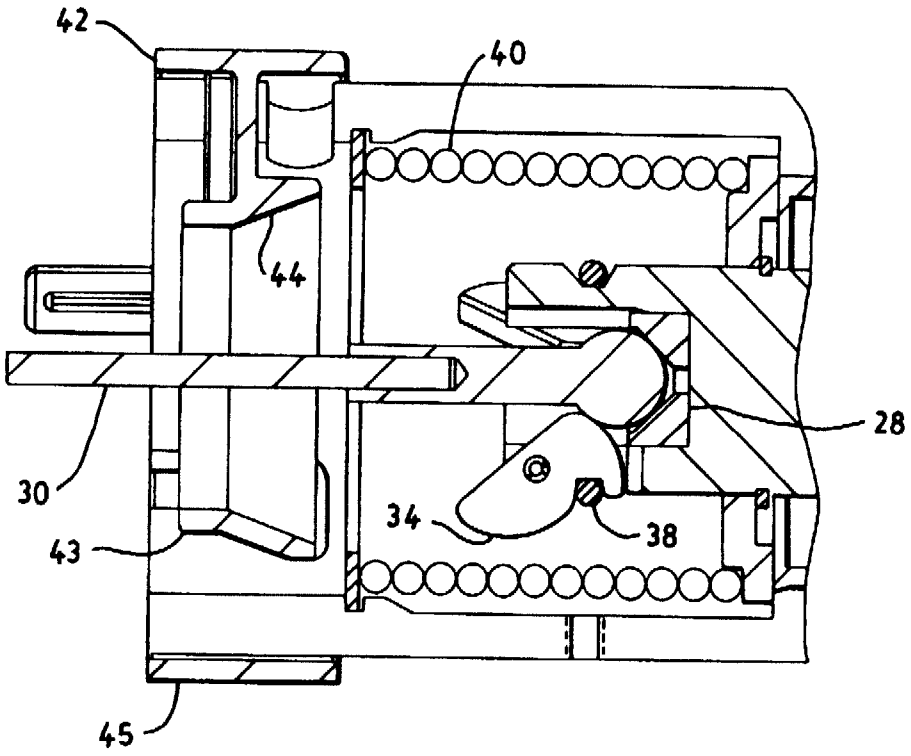
Figure 2B:
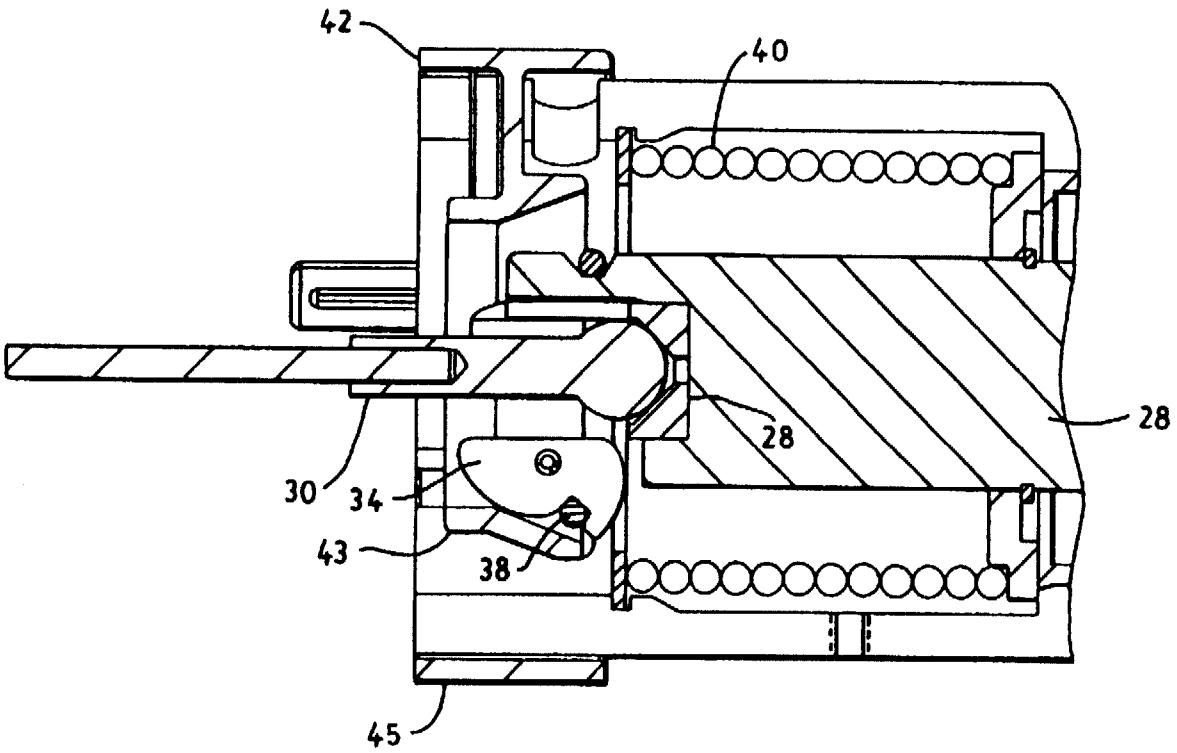
Figure 3:
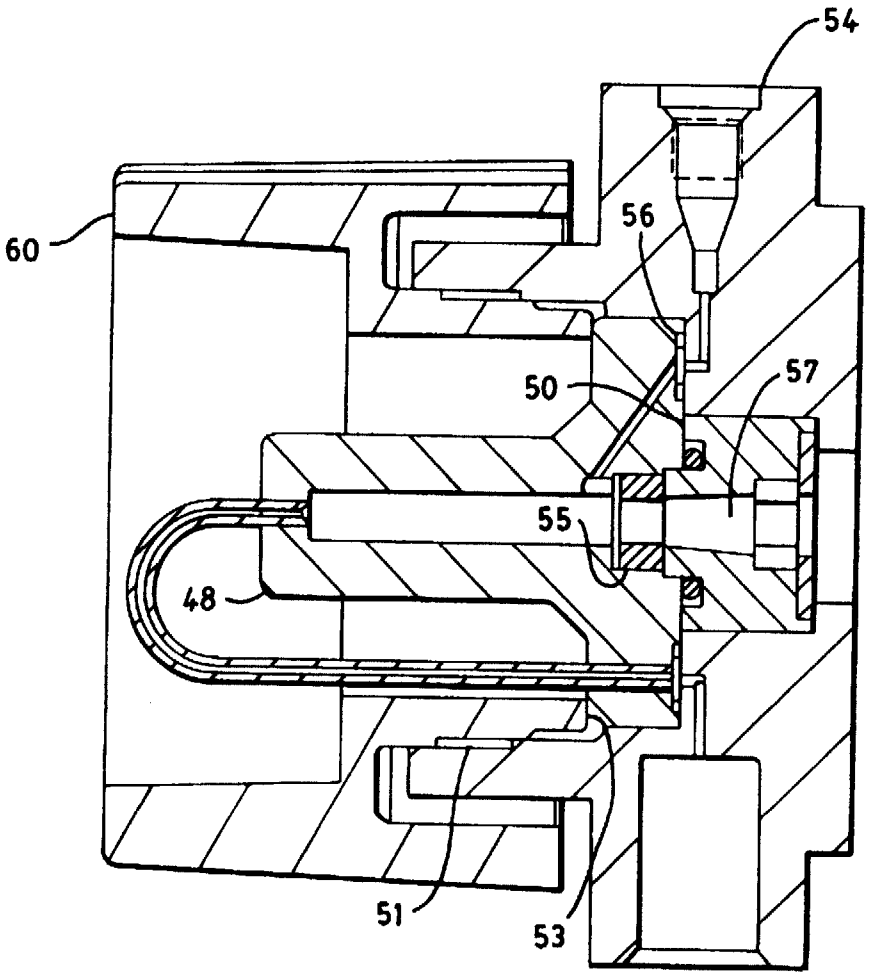
Figure 4:
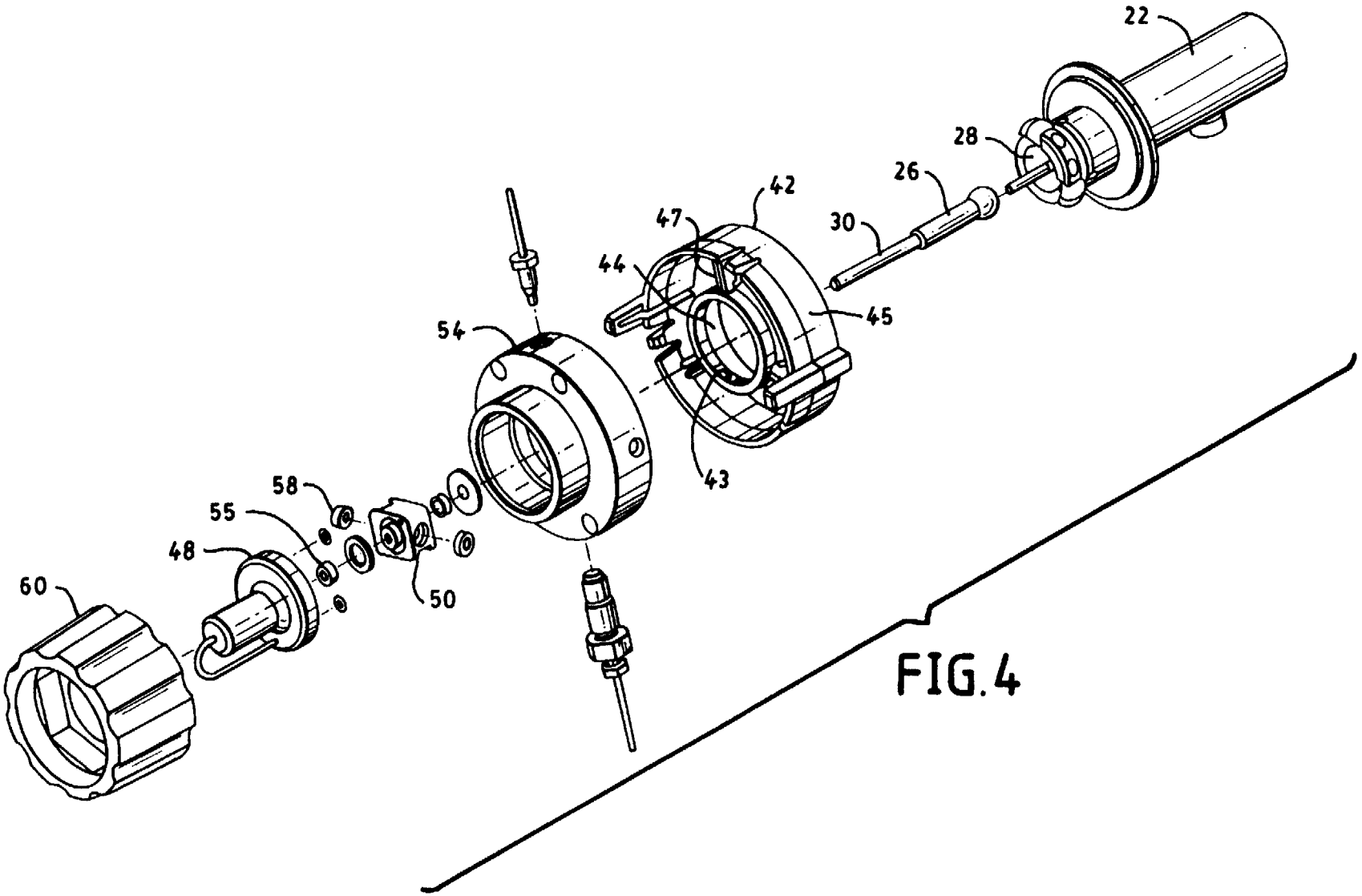

The invention will be more fully understood from the following detailed description of illustrative embodiments taken in conjunction with the accompanying drawing in which:

FIG. 1 is a plan view in section of a pump configured for tool-less pump head and plunger removal according to the invention;

FIGS. 2*a* and 2*b* are plan views in section of a tool-less plunger removal assembly of the pump of FIG. 1;

FIG. 3 is a plan view in section of a pump head assembly of the pump of FIG. 1; and FIG. 4 is a perspective, exploded view of a pump head end portion of the pump of FIG. 1.

5. DETAILED DESCRIPTION

A pump according to the invention, illustrated in FIG. 1, has a motor end 10 and a pump head end 12. At the motor end, a motor 14 is configured, in this illustrative embodiment, to drive a ball-screw assembly 16 as known in the art. The ball-screw assembly includes a screw portion 18 rotated by the motor to linearly actuate a nut portion 20. A nut cap assembly 22 is disposed on the nut portion 20 and extends through a bushing 24 toward the pump head end 12 of the pump. Mechanisms to retain a plunger assembly 26 are disposed at an end of the nut cap assembly 22 distal to the nut portion 20 of the ball-screw assembly. The mechanics of the pump assembly, substantially as described hereinafter, are housed in a mechanics housing 27.

A plunger socket 28, best illustrated in FIGS. 1, 2*a* and 2*b*, is formed of bronze or brass and configured to receive the plunger assembly 26. The plunger assembly includes a sapphire plunger 30 fixed to a plunger holder ball 32 that is accommodated by the socket 28. The plunger holder ball 32 is captured within the socket 28 by a plurality of cams 34 engaging and permitting limited pivotal motion of the plunger holder ball 32 within the socket. The cams 34, in this illustrative embodiment three cams, are distributed substantially equidistantly about the circumference of the nutcap 22 and are constantly loaded by a garter-type spring 38. The spring 38 forces the cams 34 to rotate, with a portion of the cams rotating inwardly and collapsing onto the plunger holder ball 32 pushing it tightly into the socket 28 capturing the plunger assembly 26 to eliminate backlash between the plunger assembly and the nutcap assembly. A compression spring 40, which does not need to be removed to remove either the pump head or the plunger assembly, is incorporated in this illustrative design to eliminate backlash between the nutcap, thrust bearing and other drive components.

To release the plunger holder ball 32 from the socket 28, the engaged plunger assembly 26 is driven into a release or restricting cone 42, manually or by operation of the motor 14. To use the motor to drive the plunger assembly into the restricting cone, the cone is moved into the normal travel path of the mechanism to allow the cams to engage the cone, as best seen in FIG. 2*b*. The restricting cone 42 has an inclined inner surface 44 which engages a surface of the cams 34 and rotates the cams away from the plunger holder ball 32 to release it. Engaging the surface of the cams against the inclined surface 44 of the restricting cone 42 automatically releases the plunger, not requiring an operator to have to manually disassemble the pump to remove the plunger. This avoids possible damage to the pump and saves a considerable amount of time.

The cams 34 are designed in such a way that, while the cams hold the plunger holder ball 32 into the socket with considerable force, the force required to release the cams is much lower. This is achieved through mechanical advantage. The ball of the plunger assembly has a fixed radius while the surface of the cam has a gradually increasing radius. When the garter spring (FIGS. 2 and 2*b*, 38) rotates the cam about its pivot point the increasing radius of the cam jams against the ball of the plunger assembly. In other words, the surface of the cam which contacts the ball on the plunger assembly has a low angle of contact with respect to the force from the garter spring. The same low angle mechanical advantage is used by the restricting cone 42 for releasing the ball on the plunger assembly. When the cone is in position, as described hereinafter, the cams contact the cone's inclined inner surface 44 on a side causing the cam to rotate away from the ball of the plunger holder thus allowing release.

The restricting cone 42 is configured to be manually moved into position by the operator, thus not requiring additional strokes of the pump mechanics to actuate the plunger for release of the plunger assembly. The restricting cone is a unitary molded part that consists of two concentric rings. An inner ring 43 has the inclined surface 44 that contacts the cams. An outer ring 45 is external to the pump housing and is accessible to an operator. The two rings 43, 45 are connected by a plurality of equidistantly distributed spokes 47 (best seen in FIG. 4). The spokes 47 pass through L-shaped slots (not shown) in the mechanics housing 27 that allow an engaged position at the base of the "L" and a disengaged position at the top of the "L". The operator would be required to push the outer ring of the restricting cone 42 back toward the base of the "L" and rotate the ring to lock it in position for plunger removal. This moves the inclined surface 44 of the restricting cone 42 into the normal travel or stroke of the pump, so as to not require additional stroke. When the pump is driven forward the cams will engage the inclined surface of the cone causing the cams 34 to rotate and release the plunger ball 32.

In removing the plunger assembly 26, the operator does not have to remove a manifold 54, described hereinafter, which receives fluidic connections and is configured so that the plunger can fit through a clearance hole in the manifold 54. The plunger is then accessible from the pump head end 12 of the pump to be simply pulled out of the socket 28 while the cams 34 have released the ball 32.

Referring now to FIGS. 1, 3 and 4, fluidic connections directly to the pump head are eliminated according to the invention in order to facilitate tool-less removal of the pump head and plunger assembly. The manifold 54, best illustrated in FIGS. 3 and 4, is disposed adjacent to the plunger release cone 42. The manifold 54 is configured to accept all the fluidic connections that in prior art pumps typically are made directly to the pump head. The manifold 54 is also configured to receive a seal wash housing 50, and various seals including fluidic face seals 56 which facilitate high pressure sealing between the pump head 48 and manifold 54 when the two components are held against each other. The seal wash housing 50 configured to be disposed within the manifold, facilitates flushing of the plunger at the back of a high pressure plunger seal 55 to wash away particulates that may form thereat. The seal wash housing 50 provides a wash chamber 57 (best seen in FIG. 3), for liquid to collect and wash the plunger clean of particulate that may form due to imperfections in the high pressure seals. Low pressure seals, e.g. wash plunger seal, wash tube seal and wash face seal, are used to contain the liquid in the seal wash chamber.

Low pressure tubing seals 58 reside in the wash chamber 50 interior to the manifold 54 and are not attached to the head. The low pressure tubing seals 58 are designed to accept the tubing directly, not requiring compression fittings and thus eliminating the need for tooling to disconnect them during pump head removal. The low pressure tubing seals 58 used in this illustrative implementation are of the radial or radial-cup seal type which are configured for use in sealing shafts that are reciprocating or spinning. The seals include an internal spring which effects compression on the installed tubing. Forces exerted outwardly by the internal spring cause an expansion that effects a seal between the tubing and the seal wash housing 50.

The manifold 54, according to the invention, retains the seal wash housing 50 and receives the tubing and high pressure fittings so that the pump head 48 itself does not have to be extensively manipulated, or have things disconnected from it or reconnected to it, to remove it and replace it in the pump. The pump head 48 is seated in the manifold 54 and is retained therein by a head nut or a single, large hand operated knob or nut 60.

The head nut 60 in this illustrative embodiment, is threaded into the manifold 54, as illustrated in FIG. 3. The nut 60 has an interior portion including male threads that screw into an engagement portion including mating female threads on an interior surface 51 of the manifold 54. A front face 53 of the nut 60 contacts the pump head assembly 48 effectively clamping the head 48 to the manifold 54. Simple removal of the head nut 60 releases the pump head 48 for removal. The single, large head nut 60 or hand knob is sized to provide an ergonomic means of applying the mechanical holding force required to hold the pump head 48 in position and compress the face seals 56. The single knob or nut 60 eliminates the possible cocking that two bolts used in the prior art may introduce.

To remove the plunger assembly, the operator removes wash tubes connected to the seal wash housing in the manifold as discussed hereinbefore. This operation, again, does not require any tools. The operator then manually removes the head nut 60. The release cone 42 is then manually actuated into position by the operator grasping the outer ring or portion 45 and moving the release cone 42 back engaging the spokes thereof in the base of the L-shaped slots. The plunger assembly is then actuated outwardly by the motor as directed by the operator, to engage the cams against the inclined surface of the release cone and release the plunger holder ball. When the plunger release mechanism, i.e. restricting cone 42, cams 34, is used, according to the invention, during removal of the pump head assembly 48, the plunger assembly 30 can be removed by the operator along with the seal wash chamber or housing 50 and the pump head 48, minimizing the risk of broken plungers (and dropped or lost parts). Again, no tools are required.

The manifold 54 remains attached to the mechanics housing 27, with the release cone 42 captured therebetween. The delicate plunger is protected during this tool-less disassembly process by the fact that it is allowed to remain in the pump head during the removal process. The pump head 48 is removed with the plunger retained in the head by seal friction. Once the head is removed, the plunger and head can be manually separated without constraint (prior art mechanisms required the removal of the pump head with the plunger still rigidly attached to the pump which caused damage to the plunger if the head was cocked or jarred during removal).

Another significant advantage, among others, of the pump according to the invention, is that because the plunger assembly 26 does not have to be installed before installing the pump head 48, the plunger assembly 26 can be inserted into a plunger seal 52 already installed in the pump head 48 in a visible and controlled fashion, thus virtually eliminating the possibility of damage to the plunger seal during installation. This also allows the operator to assemble any plunger bearings and seal wash parts in a vertical manner minimizing dropped and or lost parts.

Although the illustrative embodiment described herein includes a plunger holder "ball" and "socket" interfacing the plunger to the actuator/motor, it will be appreciated that mechanics other than a ball and socket could be implemented to releasably interface the plunger to the actuator, e.g. the ball could be a square or rectangular geometry or the like, while the socket could be a corresponding seating mechanism configured to receive the base of the plunger holder.

While the engagement between the manifold and pump head described herein is sealed by "face seals" it will be appreciated that other sealing members, such as O-rings, gaskets or the like could be implemented.

It should be appreciated that although the illustrative embodiment of the invention described herein includes a restricting cone 42 with an inclined inner surface for actuating cams 34 to release the plunger assembly 26, cams 34 can be manipulated or actuated by a mechanism other than an inclined surface, such as by a tab or ridge or the like that effects actuation of the cams.

Although a large hand knob or head nut 60 is described herein in the illustrative embodiment according to the invention, it will be appreciated that a wing or butterfly nut or other manually manipulable means for applying mechanical force to retain the pump head in the manifold could be implemented, such as bayonet type devices, clamps or the like. Similarly, while the manifold is described as having female threads for engaging corresponding male threads on the head nut, it will be appreciated that the thread configuration could be reversed, or alternative manually effected mechanical interconnection can be implemented. For instance, while the head nut herein is integral to the pump head end when installed, in alternative embodiments a removable knob or manually actuatable tool that need only be present for assembly and disassembly can be implemented.

While the plunger assembly holding mechanism described herein includes three cams, it will be appreciated that greater or fewer cams can be implemented in a design according to the invention. Additionally, alternative holding mechanisms, such as a ball and detente or other quick release mechanisms can be implemented.

Furthermore, while the low pressure tubing seals in the illustrative embodiment described herein are radial-cup seals it will be appreciated that other configurations can be implemented for low pressure tubing interconnections that can be manually effected, such as other friction fittings, manually actuatable clamps or the like.

Although the invention has been shown and described with respect to an exemplary embodiment thereof, various other changes, omissions and additions in the form and detail thereof may be made therein without departing from the spirit and scope of the invention.

What is claimed is:

1. A pump having a housing having an exterior, said pump for delivering pressurized fluid via reciprocation of an actuator portion of said pump driving a plunger that is removable from said pump, comprising:

a plunger assembly including a plunger interface attached to said plunger;

a plunger socket driven by said actuator and configured to receive said plunger interface;

at least one holding mechanism proximate to said plunger socket and configured to releasable engage said plunger interface to retain it in said plunger socket; and a release mechanism accessible from said exterior of said pump housing and configured to be actuable between a first position and a second position, said release mechanism being clear of said at least one holding mechanism when said plunger is reciprocating and said release mechanism is in said first position, and said release mechanism including a surface that is engagable by said at least one holding mechanism to release said plunger interface when said release mechanism is in said second position, wherein said plunger is removable from said pump by actuating said release mechanism to said second position and by actuating said actuator portion into a position whereat said at least one holding mechanism engages said surface of said release mechanism to release said plunger interface whereupon said plunger interface is removable from said plunger socket.

2. The pump of claim 1 wherein said actuator portion includes a ball-screw assembly having a screw portion and a nut portion with a nutcap disposed proximate to and being actuatable by said nut portion as said nut portion is driven along said screw portion, and wherein said plunger socket is disposed at an end of said nutcap.

3. The pump of claim 1 wherein said at least holding cam mechanism comprises a plurality of cams disposed proximate to said plunger socket and a garter-type spring biasing said plurality of cams into engagement with said plunger interface to retain it in said plunger socket.

4. The pump of claim 1 wherein said plunger comprises a sapphire rod.

5. The pump of claim 1 wherein said plunger interface attached to said plunger comprises a plunger holder ball and said plunger socket driven by said actuator is configured to receive said plunger holder ball.

6. The pump of claim 1 wherein said release mechanism comprises an exterior ring accessible from exterior to said pump connected to an interior ring, said interior ring includes said surface in the form of an inclined interior surface, said exterior ring being graspable by an operator to actuate said release mechanism between said first position and said second position, said inclined interior surface being engaged by said at least one holding mechanism to release said plunger interface when said release mechanism is in said second position and when said actuator portion is moved into a position whereat said at least one holding mechanism engages said inclined interior surface of said release mechanism to release said plunger interface whereupon said plunger interface is removable from said plunger socket.

7. A pump having a motor end and a pump head end and a mechanics housing disposed therebetween, said pump head end having a pump head removably disposed therein, comprising:

a manifold configured to receive fluidic connections to said pump, said manifold having a first end proximate to said mechanics housing and a second end including an engagement portion, said second end configured to receive said pump head therein; and a manually actuatable head nut having an external surface and an interior portion engagable with said engagement portion of said manifold, at least one interior surface of said head nut abutting said pump head to retain said pump head in said manifold when said interior portion is engaged with said engagement portion of said manifold, wherein said pump head is removable from said pump head end of said pump by grasping said external surface of said manually actuatable head nut and disengaging said interior portion from said engagement portion of said manifold to disengage said at least one interior surface of said head nut from abutment with said pump head.

8. The pump of claim 7 further including at least one face seal disposed between said manifold and said pump head to effect sealing therebetween.

9. The pump of claim 7 further including a seal wash housing disposed within said manifold to receive fluidic connections, said seal housing configured to receive seals sealing said fluidic connections at said seal wash housing.

10. The pump of claim 9 wherein at least some of said fluidic connections are low pressure connections and said seal wash housing is configured to receive low pressure seals, said low pressure seals including radial-cup seals.

11. A pump having a motor end and a pump head end and a mechanics housing disposed therebetween, said pump head end having a pump head removably disposed therein delivering pressurized fluid via reciprocation of an actuator portion of said pump driving a plunger that is removable from said pump, comprising:

a plunger assembly including a plunger interface attached to said plunger;

a plunger socket driven by said actuator and configured to receive said plunger interface;

at least one holding mechanism proximate to said plunger socket and configured to releasably engage said plunger interface to retain it in said plunger socket;

a release mechanism accessible from exterior to said pump and configured to be actuatable between a first position and a second position, said release mechanism being clear of said at least one holding mechanism when said plunger is reciprocating and said release mechanism is in said first position, and said release mechanism including a surface that is engagable by said at least one holding mechanism to release said plunger interface when said release mechanism is in said second position, said release mechanism having a release mechanism interior clearance permitting said plunger assembly to pass therethrough;

a manifold adjacent said release mechanism configured to receive fluidic connections to said pump, said manifold having a first end proximate to said mechanics housing and a second end including an engagement portion, said second end configured to receive said pump head therein, said manifold having a manifold interior clearance permitting said plunger assembly to pass therethrough; and a manually actuatable head nut having an external surface and an interior portion engagable with said engagement portion of said manifold, at least one interior surface of said head nut abutting said pump head to retain said pump head in said manifold when said interior portion is engaged with said engagement portion of said manifold, wherein said plunger assembly is releasable by actuating said release mechanism to said second position and by actuating said actuator portion into a position whereat said at least one holding mechanism engages said surface of said release mechanism to release said plunger interface whereupon said plunger interface is removable from said plunger socket and said plunger is frictionally engaged within said pump head, and said pump head with said plunger frictionally engaged therein is removable from said pump head end of said pump by grasping said external surface of said manually actuatable head nut and disengaging said interior portion from said engagement portion of said manifold to disengage said at least one interior surface of said head nut from abutment with said pump head freeing said pump head for removal with said plunger assembly.

12. The pump of claim 11 wherein said actuator portion includes a ball-screw assembly having a screw portion and a nut portion with a nutcap disposed proximate to and being actuatable by said nut portion as said nut portion is driven along said screw portion, and wherein said plunger socket is disposed at an end of said nutcap.

13. The pump of claim 11 wherein said at least one holding mechanism comprises a plurality of cams disposed proximate to said plunger socket and a garter-type spring biasing said plurality of cams into engagement with said plunger interface to retain it in said plunger socket.

14. The pump of claim 11 wherein said plunger comprises a sapphire rod.

15. The pump of claim 11 wherein said plunger interface attached to said plunger comprises a plunger holder ball and said plunger socket driven by said actuator is configured to receive said plunger holder ball.

16. The pump of claim 11 wherein said release mechanism comprises an exterior ring accessible from exterior to said pump connected to an interior ring, said interior ring includes said surface in the form of an inclined interior surface, said exterior ring being graspable by an operator to actuate said release mechanism between said first position and said second position, said inclined interior surface being engaged by said at least one holding mechanism to release said plunger interface when said release mechanism is in said second position and when said actuator portion is moved into a position whereat said at least one holding mechanism engages said inclined interior surface of said release mechanism to release said plunger interface whereupon said plunger interface is removable from said plunger socket.

17. The pump of claim 11 further including at least one face seal disposed between said manifold and said pump head to effect sealing therebetween.

18. The pump of claim 11 further including a seal was housing disposed within said manifold to receive fluidic connections, said seal wash housing configured to receive seals sealing said fluidic connections at said seal wash housing.

19. A method for manually disassembling a pump to remove a pump head and plunger assembly therefrom, said method comprising the steps of:

manually unbolting a head nut knob to free said pump head;

manually positioning a release mechanism to effect release of said plunger assembly; and driving said plunger assembly into a position whereat said plunger assembly is released from fixed engagement in said pump and is frictionally engaged within said pump head.

20. The method of claim 19 further including a step of manually removing fluidic connections from a manifold portion of said pump.

* * * * *